United States Patent [19]

Clayton

[11] 4,202,915

[45] May 13, 1980

[54] MECHANICAL PLATING PROCESS

[75] Inventor: Erith T. Clayton, Baltimore, Md.

[73] Assignee: The Tainton Company, Baltimore, Md.

[21] Appl. No.: 948,230

[22] Filed: Oct. 3, 1978

[51] Int. Cl.[2] ..... C23C 17/00

[52] U.S. Cl. ..... 427/47; 427/11; 427/127; 427/192; 427/292; 427/328; 427/445; 118/76; 118/244; 118/259

[58] Field of Search ..... 427/11, 191, 192, 367, 427/368, 429, 47, 127, 292, 328, 445; 118/244, 76, 77, 258, 259

[56] References Cited

U.S. PATENT DOCUMENTS

| | | | |
|---|---|---|---|
| 3,132,043 | 5/1964 | Clayton | 427/242 |
| 3,700,505 | 10/1972 | Kanter | 427/11 |

FOREIGN PATENT DOCUMENTS

| | | | |
|---|---|---|---|
| 2309336 | 8/1974 | Fed. Rep. of Germany | 427/11 |
| 863087 | 3/1961 | United Kingdom | 427/11 |

*Primary Examiner*—Ralph S. Kendall
*Attorney, Agent, or Firm*—Larson, Taylor and Hinds

[57] ABSTRACT

A mechanical plating process in which a work piece is plated without the necessity of tumbling the work piece in a barrel. A plating member having a plurality of plating elements is positioned with the plating elements adjacent a surface to be plated. Void spaces between the plating elements form reservoirs for liquid plating medium, containing a carrier liquid and plating metal particles. The liquid plating medium is supplied to the work area and to the reservoirs formed by the void spaces. A mechanical plating layer is formed by the plating metal particles by moving the plating member over the work surface with the plating elements, such as bronze wire elements, urged against the work surface. Additional plating medium is supplied to the work area and to the reservoirs during the plating operation to build up an adherent, mechanically applied, metal coating. The plated metal particles are preferably supplied to the work zone in flocculated form.

28 Claims, 10 Drawing Figures

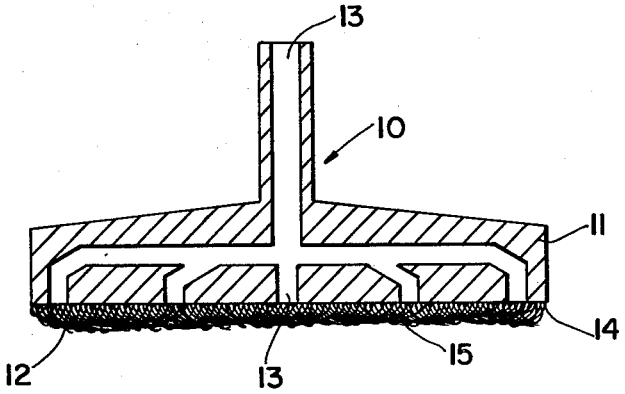
FIG. 1
FIG. 2
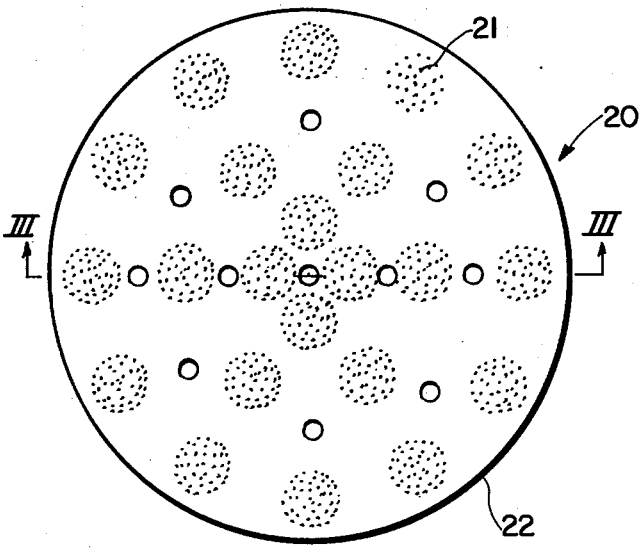
FIG. 3
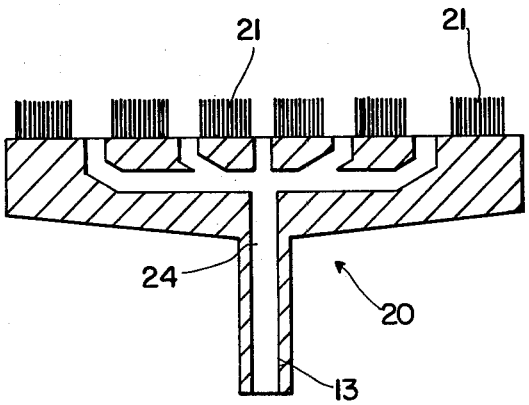
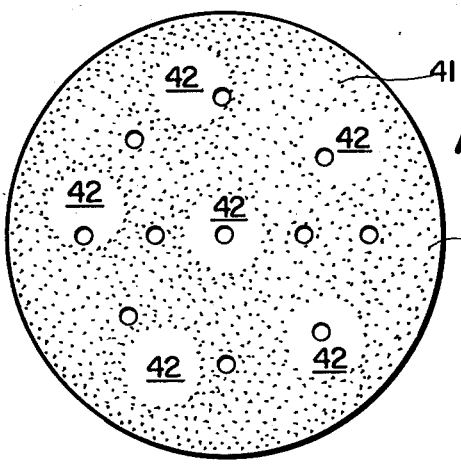
FIG. 4
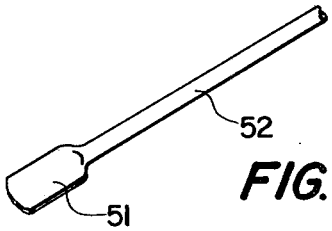
FIG. 5

MECHANICAL PLATING PROCESS

BACKGROUND OF THE INVENTION

This invention relates to a mechanical plating process. More particularly, the invention relates to an improved mechanical plating process of the type in which a tenaciously adherent metallic coating is applied on a surface of an object by subjecting metal particles to mechanical energy in a liquid medium to flatten and cold weld the metal particles to the object surface to build up a continuous adherent metallic coating on the surface. Such mechanical plating processes are described in my earlier U.S. Pat. Nos. Re23,861; 2,689,808; 2,640,002; 3,023,127; 3,132,043; 3,479,209, which are herein incorporated by reference, and elsewhere.

The foregoing and other patents which followed, launched a whole new field of plating that was new and unique in that it used mechanical energy to build up the coating instead of thermal or electrical energy. Thus, the mechanical plating process is distinct from electroplating techniques, hot melt plating techniques (e.g. galvanizing) and the like and also from paints, such as zinc rich paints, in which metal particles are adhered to a substrate by means of a paint binder. Over the years, mechanical plating has grown, and commercial plants, numbering in the hundreds, are operating in various countries around the world. In current commercial operations, objects to be coated, plating metal, promoter chemicals and, optionally, impacting media (such as glass beads) are charged into multisided barrels which are rotated horizontally to produce coated objects by the tumbling mechanical action within the barrel. The coating, typically 0.00025 inches thick, is satisfactory in all respects. However, using optimum equipment and formulations, a processing time of at least about 30 minutes is ordinarily required. Moreover, barrel processing is inherently limited to the coating of objects small enough to fit within the rotating barrel. In general, therefore, barrel processing is limited to providing relatively thin coatings on relatively small objects and requires relatively long processing times.

It is an object of the present invention to provide an improved mechanical plating process. It is a further object to provide a mechanical plating process which can be used to provide relatively thick coatings, to provide coatings on large objects, and to provide coatings in a very short time.

BRIEF SUMMARY OF THE INVENTION

The foregoing and other objects of the invention which will be apparent to those of ordinary skill in the art, are achieved according to the present invention by positioning a mechanical plating member adjacent the surface of an object to be plated, the plating member having a plurality of plating elements with void spaced separating the plating elements from one another, the void spaces forming reservoirs for particles of metal to be plated on said surface, providing a liquid plating medium comprising a liquid carrier and solid metal plating particles in the reservoirs formed by said void spaces of said plating member and in contact with said surface to be plated, said plating member being positioned relative to said object surface such that said plating elements are urged against said object surface, moving said plating member relative to said object surface in said relative position thereby subjecting said metal particles to mechanical energy sufficient to flatten and cold weld said metal particles to the object surface as a continuous adherent metal coating, and, while moving said plating member relatively to said object surface, providing an additional quantity of said liquid medium in said reservoirs and in contact with said surface to be plated to build up a continuous adherent metallic coating on said surface. A good mechanically plated metal coating is thus provided in a very short time, for example, 30 seconds or less.

DETAILED DESCRIPTION

There follows a detailed description of the invention including preferred embodiments and several drawings in which:

FIG. 1 is a diagrammatic side sectional elevation view of a plating member in accordance with the invention;

FIG. 2 is a diagrammatic bottom view of a further plating member in accordance with the invention.

FIG. 3 is a diagrammatic side sectional elevation view of the plating member of FIG. 2;

FIG. 4 is a diagrammatic bottom view of a further plating member in accordance with the invention;

FIG. 5 is a diagrammatic perspective view of a portion of a plating element in accordance with the invention;

Figure 7:
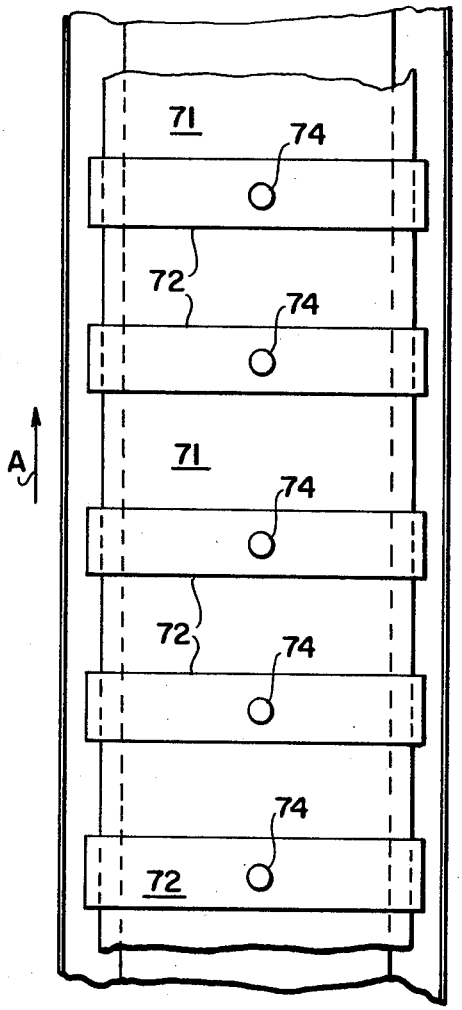
FIG. 7 is a diagrammatic plan view of a portion of a system for continuous operation of a method in accordance with the invention.

Mechanical plating has many advantages over other plating processes including electroplating and hot dipping. Among these advantages are: lower energy requirements; lower air pollution; relatively easy and inexpensive treatment of waste liquid; and no hydrogen embrittlement either in the coating metal or the plated object. In accordance with the present invention, these and other advantages of the mechanical plating process are retained and in addition, the present invention offers the following additional advantages: high speed; reduced capital costs; heavier coatings; and applicability to elongate and large objects. The present invention requires no heating, either of the work being plated or the materials used. Suitable equipment is inexpensive and easily fabricated. Portable equipment may be readily provided for application of coatings to existing structures such as bridges. Thus, capital costs are low relative to other plating processes. The process is also applicable to elongate and large objects such as sheet metal, wire, and the like, and is readily adapted to continuous operation. Heavier coatings can be laid down at little or no cost other than the cost of the additional coating metal.

Several other advantages of metal coatings provided by the present invention are:

1. Smooth, lustrous coatings;
2. Good ductility-even fairly heavy coatings tolerate a 180° bend;

3. No danger of warping or distortion such as may result from high temperatures inherent in hot dip galvanizing;

4. Codeposition of two or more separate metals without alloying;

5. Layered coatings;

6. Coating on one surface only or on any portion of a surface;

7. Freedom from porosity;

8. Adhesion superior to hot dip galvanizing.

The most significant advantages, by far, of the present invention relative to earlier mechanical plating processes are the marked reduction in processing time and the elimination of the requirement for tumbling barrels. Others have attempted to achieve these objects but the products have been inferior. One such method is disclosed in U.S. Pat. No. 3,754,976 and involves blowing finally divided aluminum powder admixed with iron shot through a tube, the rapidly moving particles impinging upon a steel surface. In my experiments with this and similar processes, the coatings were inferior and not commercially acceptable.

It will be apparent to those knowledgeable in the mechanical plating field that the task of substantially decreasing the processing time of the mechanical plating process is complex. High speed plating necessarily means that the plating force is increased many times over that normally used in barrel processes. Fast barrel plating times are in the range of 25–40 minutes. If plating is to be accomplished in, say, 10 seconds, then the plating rate must be 180 times faster than that occuring in a 30 minute barrel process. Even if the plating time takes a whole minute, plating still occurs at a rate 30 times faster than in a 30 minute barrel process. Not only is the processing time shorter, the coating thickness may also be increased well above the thin coatings normally achieved in barrel processing. It will be apparent that the very fast plating rate achieved in the present invention means that cold welding must occur at a rate of hundreds or thousands of times faster than that required in conventional barrel processes in use today.

In accordance with the present invention, these high plating rates and coating thicknesses are achieved by employing a special mechanical plating member which is moved relative to the surface of an object to be plated and by providing a supply of liquid medium containing the metal plating particles to the plating member sufficient to meet the demands made by the increased plating rate. The mechanical plating member has a plurality of plating elements with void spaces separating the plating elements from one another. The void spaces form reservoirs for the metal plating particles and the liquid carrier.

The plating member is positioned adjacent to the object surface such that the plating elements are urged against the object surface. The plating member is moved relative to the object surface while being maintained in its adjacent position. The metal particles in the liquid medium supplied to the plating member and to the object surface are thereby subjected to mechanical energy sufficient to flatten and cold weld the metal particles to the object surface as a continuous adherent metal layer of the type laid down in mechanical plating processes. Additional liquid medium, containing metal plating particles, is supplied to the work area during the plating operation.

It will be understood in the foregoing and in the claims hereto appended that, where reference is made to the plating member or elements being "urged against" or "pressed against" the object surface, the plating member or elements actually press against the liquid medium and metal plating particles which are supplied to the work area and interposed between the plating member or elements and the surface of the object being plated.

It is essential, in practicing the invention, to provide a supply of metal plating particles in liquid medium to that portion of the object surface (the work area) over which the plating member moves. This is accomplished, in accordance with the invention, by providing the plating member with channels, grooves slots, openings, or other void spaces between plating elements which form reservoirs to supply plating metal particles for the plating operation and by maintaining a supply of the plating metal particles to those reservoirs and to the work area sufficient to meet the demands of the rapid plating process.

An adequate supply of plating metal particles can be maintained by effecting a flow of liquid plating medium containing plating metal particles to the reservoirs in the plating member. This is conveniently carried out by pumping the liquid medium from a reservoir through suitable conduits to the reservoirs in the plating members. Gravity flow may also be used. In either event, the plating metal particles are disposed in a liquid carrier. The liquid carrier is preferably aqueous, still more preferably water. The metal particles are, of course, much heavier than water and will rapidly settle out with a consequent impairment of process efficiency. Accordingly, agitation and/or dispensing agents may be added to facilitate dispersion of the metal particles in the aqueous system.

In a preferred embodiment of the invention, the form of the metal particles is changed into a floc or light-weight agglomerate and the metal particles are supplied to the work area and to the reservoirs of the plating member in this floc form. Several different sizes, shapes and types of floc may be formed and all are useful in the present invention. Some float in water and may be as large as a fifty cent piece while others sink in water and are generally spherical, of varying diameter, e.g. 1/16 inch. Those which float when freshly formed may, after a time, tend to sink in water. In each instance, however, the floc is in the form of a loosely held light-weight aggregate or agglomeration of metal particles. The metal particles are preferably fine (e.g. zinc dust having an average particle size of 7–8 microns) and an individual agglomerate will typically contain thousands of such fine metal particles. The agglomerates are very much lighter in weight then the metal particles themselves. Zinc, for example, has a specific gravity of over 7 whereas zinc dust floc useful in the present invention may have a specific gravity of less than 1 such that the floc will float. Heavier floc is, however, useful including flocs that will sink in water. In general, the primary requirement is to deliver the metal particles to the work area. Metal particles themselves, being relatively heavy, will settle out of liquid carriers rapidly and extensive agitation is ordinarily required to retain them dispersed in the liquid. Metal particles which settle out are, of course, lost to the process and a tendency to settle out will mitigate against the important objective of delivery of metal particles to the work area. The light-weight flocs are easily dispersed, in part because of their light-weight, and it is thus preferred that their weight is such as to facilitate dispersal in the carrier liquid, particularly aqueous carrier liquids, and more particularly, water. In general, therefore, the floc agglomerates preferably have a specific gravity of less than 2.0, preferably less than 1.5 and more preferably, less than 1.0. As a practical matter, a specific gravity of less than about 0.2 is undesirable since the dispersal of very light-weight floc in an aqueous system becomes increasingly difficult. The individual metal particles are loosely held in the floc particles or agglomerates and these are readily broken up in the present method by the action of the plating members.

The number of metal particles in the individual floc agglomerates will vary widely depending, inter alia, on the size of the metal particles and the manner in which the particles are flocced. The larger floc particles will contain upwards of several hundred thousand metal particles where the particles are in the form of fine powders (e.g. 7 microns zinc dust). Smaller floc particles will contain upwards of 25,000 of these fine powders.

In general, the agglomerates or floc particles will contain more than 100 metal particles and usually more than 1000 metal particles.

The process results in the formation of metal coatings which are similar to those provided in the barrel process of mechanical plating described above, and the various plating metals and surfaces to be plated can be any of those known in the barrel process. The usual surfaces to be plated are metal, and the common plating metals include zinc, tin, lead, cadmium, copper, aluminum, magnesium, silver and gold and alloys such as brass. The metal particles are preferably small in size such as powders and dusts to facilitate floccing. An average particle size of not more than about 100 microns is preferred, an average size of not more than about 50 microns is more preferred, and an average size of less than about 20 microns is still more preferred.

The carrier liquid used in the liquid medium can be any of the carrier liquids used in the barrel process and water is preferred. The liquid medium may include any of the conventional chemical plating promoters used in the barrel process. Further details concerning the plating metal surfaces to be plated, carrier liquid, and chemical plating promoters conventionally employed in the barrel process will be found in my earlier patents noted above and herein incorporated by reference in these respects.

Floc may be formed in accordance with the invention in any convenient way such as by using, as the carrier liquid, water which has been acidified with a mineral acid, such as sulfuric or hydrochloric acid. In general, a pH of 1.6 to 3.5 is preferred with maximum flocculating usually occurring at a pH of about 1.8 to 2.4. As will be seen in the Examples which follow, excellent results are achieved with zinc dust using acidified water as the carrier liquid. Flocculating agents can also be used. The nature of the flocculating agent can vary widely. The only requirement is to form the light-weight loosely held aggregates described above and it is a simple matter to simply stir up metal particles, carrier liquid, and a potential flocculating agent to determine its efficacy. The results of flocculation are readily discernible: in addition to the formation of the flocs themselves, the liquid carrier becomes quite clear as the floc is formed. This, in turn, renders the individual flocs themselves more readily visible. This entire effect is totally different from that resulting from dispersing, e.g. zinc dust in water. Suitable flocculating agents include acids, both inorganic and organic, conventional chemical plating promoters and lead iodide. Organic acids, such as glycolic acid, diglycollic acid, citric acid, oxalic acid, fumaric acid and itaconic acid, function well. Heating the liquid medium has also been found to enhance floc formation. Heating to a temperature of at least 100° F., preferably at least 125° F., greatly enhances flocculation. It is not necessary, however, to heat the work surface or the object being plated. Only the liquid medium itself needs to be heated to enhance floc formation. The floc is preferably pre-mixed prior to use and may be stored for a period of time prior to use.

A preferred form of plating member is shown in FIG. 1. Plating member 10 includes a support 11 and a plurality of plating elements. The plating members are in the form of a tangled mat or pad 12 of brass wires originally in the form of bristles extending downwardly, in the sense of FIG. 1, from support 11 and formed into mat form by squashing or flattening the bristles downwardly in a vise. A similar pad-like configuration can be achieved by hammering the bristles with a hammer or other tool. A convenient type of wire brush to use is available commercially as a white-walled tire brush and has a plastic body or support 11($2\frac{1}{2}'' \times 3''$ in plan), having 0.007" diameter crimped bronze wire bristles extending 13/16" out of the block and having bristles arranged in two outside rows of four holes each and seven inside rows of nine holes each. While a brush of this type can be used as such, it is preferred to mat down the bristles as shown in FIG. 1. In accordance with the invention, the body of the brush is provided with one or more conduits or passageways 13 for supplying liquid plating medium, including plating metal particles, to the bottom side 14 of the plating member 10. The exposed or bottom side 15 of the matlike layer is uneven by virtue of the tangled mat-like nature of the flattened wire bristles. It will, therefore, be readily understood that, at its outer surface 15 and throughout the mat-like layer, void spaces are formed between individual plating elements (i.e. flattend wires) making up mat layer 12. These void spaces form reservoirs for metal plating particles supplied in a liquid plating medium.

An alternative form of plating element is shown in FIGS. 2 and 3. The plating element 20 is in the form of a wire brush having a plurality of discrete bundles 21 of bronze wire plating elements. The bronze wires are imbedded in a suitable base portion 22 in any suitable fashion. Base portion 22 is circular in plan and includes a shank 23 for attachment to a rotating member such as a chuck of a variable speed drill. The plating member also includes a substantial amount of void space between the bundles, and between the individual wires of each bundle, forming reservoirs for liquid medium and metallic particles used in the plating process. In this embodiment, the void spaces adjacent the discrete wire bundles are contiguous and in the form of a continuous matrix in which the discrete wire bundles are positioned. Alternatively, wires 41 can be arranged in contiguous fashion as shown in FIG. 4 in which case the wires are disposed in the form of a continuous matrix in which discrete voids 42 are positioned. Void spaces are, of course, also present between adjacent wires 41.

Figure 6:
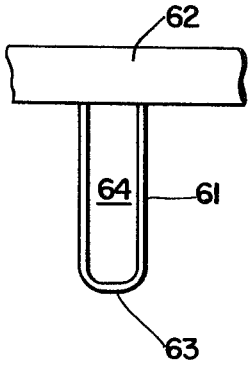
FIG. 6 is a diagrammatic side elevation view of a further plating element in accordance with the invention.

As shown in FIG. 5, the distal end 51 of each wire 52 in the brush as shown in FIGS. 2–4 is preferably flattened such that, in use, the broad side of the flattened area 51 can be pressed against the work surface. As mentioned above, the preferred form of plating member is formed of a mat or pad of tangled brass wires. However, many other configurations are suitable. The essential requirements are: (1) to provide a substantial void space to form a reservoir for liquid plating medium and metal plating particles; and (2) to hammer and cold weld the metal particles rapidly onto the surface to be coated at a high rate. Where wire brushes are used, the bristles may assume various configurations. For example, a "paper clip" or U-shaped configuration as shown in FIG. 6 is suitable. As shown therein, individual U-shaped "bristles" 61 (only one of which is shown) are secured to a base portion 62 of a plating member in any suitable manner. The bottom 63 of the "U" is the distal end of the bristle which is urged against the surface to be coated. It will be readily appreciated that the void space 64 between the "legs" of the U-shaped wire together with spaces between individual wires, provide a substantial void volume for the plating materials. Distal end 63 may be flattened similarly as described in connection with FIG. 5 to reduce abrasiveness. Irrespective of the type of bristles employed, they can be randomly or regularly arrayed.

The plating elements need not be in the form of bristles. Other forms, such as a sponge-like pad, a textile-like pad, or the like having a substantial amount of void space as mentioned above, may be employed. The plating members may also be provided with one or more conduits, such as conduit 13 in the brush shown in FIG. 1, for feeding fresh liquid medium and metal particles into the location of the plating elements.

In order to facilitate retention of plating materials in the location of the plating elements, absorbent materials may be provided in the void spaces or in the liquid plating medium. In the latter event, the absorbent materials are picked up by and held within the plating elements. Suitable absorbent materials include cotton balls, sponge, and the like which are porous and are readily wet by the plating liquid. Moreover, the body of the plating member itself may be made porous, or may include porous areas, to facilitate retention of the liquid plating medium.

In use, the plating member is positioned adjacent a surface of the object to be plated and liquid medium, containing metal particles, preferably in floc form, is provided in contact with the object surface and the plating elements and in the reservoirs formed by the voids between the plating elements. The plating member is then moved relative to the object surface, and the plating elements are urged against the object surface and move thereover. The metal particles are thus rapidly cold welded into a tenaciously adherent metal coating on the object surface.

Preferably, the relative motion between the plating elements and the work surface is at least 10 feet per second, and more preferably at least 25 feet per second, to facilitate rapid processing. It will be apparent from the description which follows, however, that much higher relative speeds can be achieved.

In one form of the invention, the plating member is one which rotates in a plane parallel to the object surface. In this form, the relative linear velocity of a stationary rotating plating element of a plating member rotating about a fixed axis, relative to a stationary object, is a function of distance from the axis of rotation. At the axis, of course, linear velocity is zero. In order to ensure that the relative linear velocity is an appropriate linear velocity, e.g. at least 10 feet per second, the plating member and object surface can be moved relative to one another at a linear velocity of at least 10 feet per second and/or the rotating plating member (or members) is moved relative to the object surface such that all portions of the surface are contacted by plating elements moving at the desired linear velocity. In the latter case, of course, the angular velocity of a rotating plating member is chosen to achieve adequate linear velocity. For example, in the case of a six inch diameter member rotating at an angular velocity of 800 r.p.m., the plating members set beyond a radius of about 1.43 inches from the axis of rotation all move at a linear velocity of at least 10 feet per second. Where the objects to be plated are elongate or continuous lengths of materials such as wire and sheet metal, an appropriate relative velocity is easily accomplished by moving the object at a suitable linear velocity past the plating member or members.

Where the object to be plated is a stationary structure, such as a bridge or the like, portable plating equipment is utilized and it is a particular advantage of the invention that such structures can be readily plated with thick protective coatings with inexpensive portable equipment. For example, on type of portable plater that works very well on horizontal surfaces is similar to a conventional home floor polisher. This type is very fast and can be equipped with a suitable container for either pumping or flowing by gravity liquid medium containing metal plating particles to the working brush or pad or similar plating member. The floor polisher type can be provided with a plastic jug, such as the type usually designed for holding shampoo solution. This can be used for storing a supply of liquid medium for use in the plating process. The storage container may be provided with an agitator to retain the metal plating particles (preferably in floc form) dispersed in the carier liquid.

For production plants as distinguished from the portable type, batteries of plating members in groups spaced down the length of, for instance, a coil of flat stock being plated would have carrier liquid and metal particles pumped to the plating members and any spill-off would be picked up by vacuum or other suitable means and returned to the supply source for reuse. Where required, agitation can be provided to keep the plating metal particles in suspension. With a rapid flow-through of materials, however, agitation would not be necessary, particularly where the metal particles are in floc form.

The liquid plating medium preferably includes chemical plating promoters. The chemical plating promoters used are of the type conventionally used in mechanical plating and details are given in my eariler patents herein incorporated by reference. The liquid medium is preferably aqueous and includes at least one film forming component which forms a thin and easily parted film on the object surface. The preferred film formers are fatty acids, saturated or unsaturated, having from 6 to 22 carbon atoms and fatty acid derivatives such as amines, amides, metal salts, and esters. The carrier liquid may be or include water in which case one or more surfactants may be used to keep the film former in solution. Conventional non-ionic, cationic and anionic surfactants may be employed and non-ionic or cationic surfactants are preferred. The carrier liquid is inert and may be or include a conventional organic solvent such as a hydrocarbon, an aromatic hydrocarbon such as xylol, naphtha or toluol, mineral spirits, alcohols, ketones, esters, or ethers. Other carriers, such as oils, plasticizers, organophosphates, etc., may be used. As mentioned above, these addenda are of the type used in conventional mechanical plating and my earlier patents are herein incorporated by reference for further details concerning same.

As will be shown in the examples which follow, I have found that excellent coatings can be obtained in very short time in accordance with the present invention. For example, coatings comparable to those previously requiring 30 minutes of barrel processing time can be achieved in 60 seconds or less and preferably in 30 seconds or less, in accordance with the present invention. It has also been found that the coating rate may be increased by elevating the temperature of the liquid plating medium above ambient temperature. Accordingly, where rapid and/or thicker coatings are required, it is preferred to carry out the process with the liquid medium maintained at a temperature above ambient, preferably at a temperature of at least 100° F., more preferably at least 125° F. While temperatures of up to the boiling point of the liquid can be employed, it is preferred to operate substantially below the boiling point, particularly where volatile organic solvents are employed, to minimize expense and hazard caused by solvent vapors.

EXAMPLE I

One hundred grams of zinc dust (median particle size 7–8 microns) is added to a previously prepared solution of 3 cc concentrated sulfuric acid dissolved in 200 cc water. The water temperature is slightly raised by the addition of the acid and the solution has a pH of 1.2. The zinc flocculates instantly when added to the acid solution: large, light-weight aggregates are formed and the liquid is clear and bright. A coppered steel panel measuring 2"×5"×1/16" thick is placed in a pan and covered with the flocculated liquid medium. A plating member as shown in FIG. 1 and as described in connection therewith is formed by pounding the flexible wire bristles with a hammer to provide a mat or pad. The plating member is attached to a rotatable chuck of a drill and the plating member is urged against a flat surface of the steel panel for one minute with the flocculated liquid plating medium adjacent the work piece and in the interstices or void spaces in the mat-like layer of the plating member. After one minute, the steel panels are removed and have a tenaciously adherent and attractive zinc coating, 0.0011 inches thick, of the type in which the metal particles are flattened and cold welded as in conventional mechanical plating processes, and as opposed to other processes such as painting, electroplating, and melt coating. The coating is smooth and bright and tenaciously adherent as determined by bending and by tape test. In the tape test, a piece of pressure sensitive adhesive tape (standard "Magic Transparent" tape, 3M Company) is pressed firmly on the coating, rubbed very hard, and then jerked off. Not a trace of zinc is removed and the bond between the zinc and the substrate is not damaged in any way. In a ductility test, the steel panel is bent 180° in a vise on a radius of about κ". The coating is not disrupted in any way. There is no spalling or cracking and, by any metallurgical standards, the coating is of very high quality. A substantial number of the panels are coated in the same way with reproducible results.

EXAMPLE II

Example I is followed except that the acid solution is made by dissolving the acid in 300 cc of water and the pH is 1.5. The coating is 0.001 inches thick and results are substantially the same as in Example I and the results are reproducible. After three months of storage, the coatings of Examples I and II show little or no tarnishing and remain bright and attractive.

EXAMPLE III

One gallon of conventional mechanical plating chemical plating promoter is made up by dissolving 0.90 lbs. of a surfactant (a polyoxyethylene oleic amine - "Nopalcol A0-45") in hot water. To this mixture is added 2.27 lbs. of citric acid anhydrous and 0.05 lbs. of a polyethylene glycol ("Carbowax 6000°). After thorough mixing, water is added sufficient to make one gallon. Small steel panels are plated in accordance with the present invention by immersing the panels, in a pan, in a liquid plating medium made up by mixing 100 cc of the conventional plating promoter just described and 500 cc of water. After heating to 140° F., 100 grams of zinc dust (average size 7–8 microns) is added and zinc floc is rapidly produced as in the previous examples. Plating is effected as in Examples I and II with a rotating member, having brass wire bristles flattened in a vise as shown in FIG. 1 and described above in connection therewith. A zinc layer having a thickness of about 0.00075 inches in thickness is produced having similar appearance and test results as the products of Examples I and II.

The foregoing Examples illustrate batch methods of carrying out the method of the present invention. It is a significant feature of the invention, however, that the method of the present invention can be carried out continuously as illustrated in the Examples which follow.

EXAMPLE IV

A ten foot length of thin strip steel 3½" wide (venetian blind stock), coppered, is pulled slowly through a pan 30 inches long and having rollers and edge guides to fix a path of motion of the steel strip through the pan. A flocculated liquid plating medium, made by premixing 1500 grams of zinc dust, 1100 cc of the chemical plating promoter of Example III, and 2500 cc water, is placed in the pan such that the steel strip, lying on the bottom of the pan, is submerged. A floor polisher fitted with two oppositely-rotating plating members of the type shown in FIG. 1 and described above is moved briskly back and forth across the upper surface of the steel strip as it is pulled through the pan. An attractive mechanically plated layer of zinc is produced and test results are similar to the previous examples.

Figure 8:
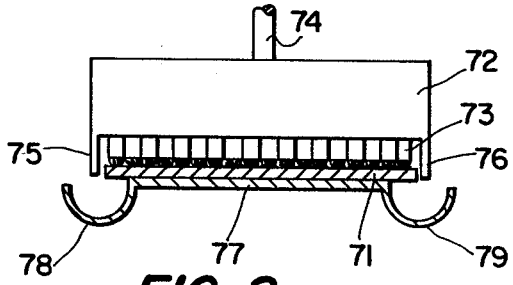
FIG. 8 is a diagrammatic side elevation view of a plating tool used in the system shown in FIG. 7.
Figure 9:
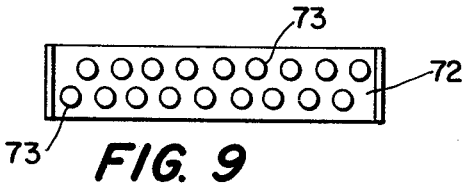
FIG. 9 is a diagrammatic bottom view of the plating tool of FIG. 8.

In a commercial plant operating on "continuous" lengths of materials, the equipment would be appropriately increased in size. An example of such a large size plant for continuously coating metal sheet stock is illustrated in FIGS. 7–10. A strip of steel 71 is moved in the direction of arrow A beneath a plurality of plating tools 72. Five plating tools 72, out of a total of twenty seven required in this system, are shown in FIG. 7. Each plating tool 72 includes a plurality of rotating plating members 73 of the type mentioned above, preferably as shown in FIG. 1. The tool is slightly over five feet in length such that the tool and plating members extend slightly over the edges of the steel strip 71. As shown in FIG. 9, the plating members are arranged in pairs (eleven shown) and the members of each pair rotate in opposite directions. The individual members are preferably arranged overlapped, in the sense that they present a continuous working zone across the width of the surface being coated.

Liquid medium containing the metal plating particles, preferably in floc form as described above, is supplied from a supply reservoir to the plating area by means of conduits 74 provided in the body of tool 72. Individual conduits may be provided to supply liquid plating medium to each rotating member 73 as shown in FIG. 1. The conduits 74 serve to supply the liquid plating medium to the plating area and to the reservoirs formed by the void spaces between the plating elements of plating members 73. Additional conduits (not shown) may be provided in tool 72 to supply liquid plating medium to the individual plating members 73. As shown in FIG. 8, the side edges 75, 76 of the housing of plating tool 72 can extend downwardly outside the outer edges of steel strip 71 and below the upper surface of steel strip 71 to facilitate retention of the liquid plating medium in the plating zone.

Figure 10:
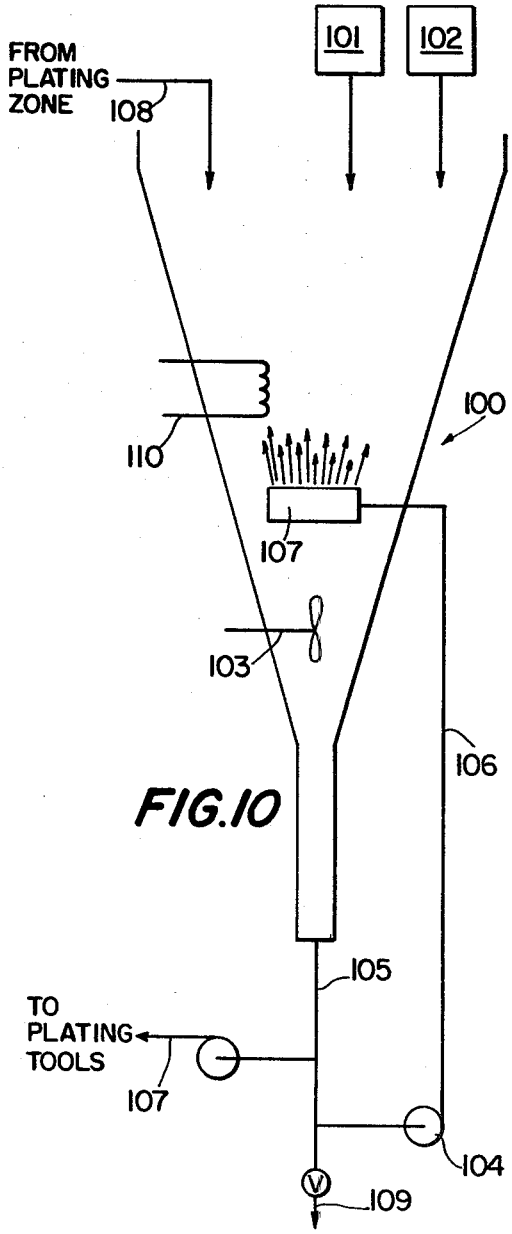
FIG. 10 is a diagrammatic side elevation view of a device used for supplying liquid plating medium in the system of FIG. 7.

The steel sheet 71 is moved, by conventional drive means, over a suitable support such as a planar support member 77 (see FIG. 8). Troughs 78, 79 are formed at the outer ends of member 77 to collect excess liquid plating medium. Liquid plating medium is conveniently made up in a cone shaped vessel 100 as shown in FIG. 10. Metal particles are metered into vessel 100 in any convenient manner from supply source 101. Carrier liquid is metered into the vessel from supply reservoir 102. Additional supply reservoirs for various items making up the medium can be provided if desired. The liquid medium is prepared by dispersing the metal particles in the liquid carrier which may be done in vessel 100 as shown or in a separate vessel for subsequent introduction into vessel 100. An agitator 103 may be provided in vessel 100 to maintain the metal particles, or flocs of metal particles, in dispersion. Agitation may also be provided in other convenient manner such as by a recirculation pump 104 which draws the liquid through conduit 105, through conduit 106 and into the body of vessel 100 by way of a sparger 107. The prepared liquid medium is passed by means of conduit 107 to plating tools 72. Some or all of the excess liquid medium collected in troughs 78, 79 may be returned, through appropriate conduit 108, to vessel 100 for reuse. In order to prevent the build-up of ineffective materials in the system, liquid medium can be removed from the system through line 109. Make-up quantities of metal particles, liquid carrier and other materials used in the liquid plating medium can be added from sources 101, 102, etc. A heating coil 110 may be provided to raise the temperature of the liquid plating medium, for example to enhance flocculation of the metal particles.

In a system such as that depicted in FIG. 10, it is quite practical to plate with one or more different types of plating metals. For example, two separate feed systems, one for liquid medium containing zinc metal particles and one for a mixture of cadmium and tin metal particles could be provided, one feeding a first set of plating tools 72 and the other feeding a second set of plating tools 72. By suitable choice of the location of the first and second sets of plating tools along the path of movement of the steel strip, various results can be achieved such as the sequential deposition of distinct layers of different metals. The system illustrated in FIGS. 7–10 and described above is designed to continuously coat a steel strip five feet in width at a linear speed of 200 feet per minute with a coating of zinc 0.0008 inches thick substantially as achieved in the batch system of Example III.

EXAMPLE V

A steel concrete-reinforcing bar (a "re-bar") is rotated between two oppositely rotating plating members of the type shown in FIG. 1 with the matted wire surfaces facing one another. The plating members are first dipped into a flocculated liquid plating medium as in Example IV. As the plating members are urged against the re-bar, the re-bar is turned such that its entire peripheral surface is treated. A bright and attractive mechanically applied zinc layer results.

EXAMPLE IV

A one and one half inch cube of steel is held in the hand with one face uppermost. A plating element of the type illustrated in FIG. 1, attached to a hand-held power drill, is immersed in flocculated liquid plating medium of the type described in Example IV and the plating element pressed against the surface for several seconds. The process is repeated several times with successive surfaces of the cube being treated, and a zinc plated cube is produced. The coating is of high metallurgical quality as in the previous examples.

As mentioned above, significant advantages in the present invention result from the ability to obtain results comparable to those obtained in commercial barrel plating processes without the necessity of operating in a barrel. Thus, the present invention enables one to obtain high quality mechanically plated coatings on substrates, such as massive structures (e.g. bridges) and "continuous" lengths (e.g. wire, strip steel) to which the barrel process is unsuited. Moreover, these results can be obtained at a greatly increased plating rate which renders the process competetive because of relatively low capital and operating costs. The quality of the coatings that can be produced is high by any metallurgical standards and coating thickness can be built up to several mils or more. Coating thickness, even when using a hand operated tool, is very uniform. Adhesion is excellent: coatings 0.003 inches thick are successfully bent 180° around a radius of 1½ inches and thinner coatings can be bent to this extent on a much smaller radius. Energy requirements will also be low relative to electroplating or hot dip galvanizing processes. The current requirements for electroplating to a thickness of 0.0008 inches would be very high. Similarly, the energy required to maintain a bath of zinc molten to accommodate a five foot wide strip of steel moving at 200 feet per minute plus that required to heat the strip itself would be enormous relative to the energy requirements of the system described above. For example, assuming one horsepower for each of the plating tools, a total of 27 horsepower would be required. Other energy requirements would be that of the relatively small pumps needed to circulate the various processing materials. The degreasing, pickling, rinsing and energy required to move the steel strip through the system would be about the same for all three systems. Overall, the present system will clearly require far less energy.

Considering such factors as the floor space required by electroplate and hot dip galvanizing, the cost of the large zinc kettles for handling a five feet wide plate moving 200 feet per minute, the erosion of the kettle sides due to the movement of the molten zinc, and the like, maintenance or replacement costs on the kettle would be high. In an electroplating system, the investment in rectifiers, copper bus-bars, and other essential equipment is very high. By comparison, the simple mechanical plating elements described which have minimal wear show large savings in investment and maintenance. In this regard, it should be noted that, in use, the individual plating elements (e.g. brass wires) become coated with plating metal particles which apparently reduces wear on the plating elements themselves.

Hot dip galvanizing lines usually do not run at more than approximately 80 or 85% efficiency, the rest of the zinc being lost in dross, skimmings and the like. In electroplate, there is the cathode efficiency, the anode efficiency and the rectifier efficiency, so the best that can be expected of an electroplating unit is about 90% zinc utilization. Mechanical plating efficiencies done in plants around the world consistently show zinc efficiencies of over 90%, sometimes 95 to 98%. There is no reason to suppose that the efficiency would be less with the high speed plating, especially since the ease of reclamation of the metal particles will be enhanced due partly to the absence of glass beads or other impact media used in admixture with the zinc in the barreling operations.

The plating elements are preferably fabricated of metal, preferably non-ferrous metal. Copper and copper alloys, including alloys with zinc (e.g. brass) with tin (e.g. bronze) with aluminum (e.g. aluminum bronze) are suitable examples.

An important feature of the present invention is that the process is readily carried out continuously on elongate substrates such as wire, sheet, and the like. In continuous operation, it is preferred to move the substrate being plated to and through a plating zone in which the metal plating is laid down in accordance with the invention. In that event, it is usually preferred to move the substrate material at a high speed, generally at least 50 feet per minute and preferably at least 100 feet per minute through the plating zone.

Reference has been made in the foregoing specification to reservoirs for plating medium formed in the spaces and interstices of the plating members. The term "reservoir" is used herein in a sense of a space or void into and through which the plating medium readily flows and is not used in a sense to imply that the plating medium is stored or held therein for any length of time. In fact, it is a feature of the invention that the liquid plating medium is not held there for any length of time: on the contrary, it moves rapidly through the void spaces to the plating elements to facilitate rapid plating in accordance with the invention.

The cost of cleaning is a major cost element in high speed hot dip galvanizing plating lines such as the Sendzimer line. In this process, steel sheet or plate moving at a speed of up to 500 feet per minute goes through a furnace where the moving sheet is raised to a temperature of about 800° C. This heating is done in a mixed atmosphere of nitrogen and hydrogen which ensures the reduction of all scale and oxides. The clean, bright metal is then run through the hot dip galvanizing tank, passing from the reducing atmosphere directly into the galvanizing bath. Because of the speed, this furnace is very long to permit sufficient dwell time in the furnace to raise the steel to a temperature of 800°. Steel is sufficiently hot when it enters the galvanizing bath that it exercises little or no cooling effect on the molten zinc in the bath. This is clearly a very expensive operation suited to very large plants plating millions of tons. Means must be provided for producing nitrogen and hydrogen to maintain a reducing atmosphere. Large volumes of heat are necessary to raise the steel to such a high temperature and the volume of steel passing through 500 feet per minute in such that the energy input in the form of heat is very intensive. All of this expensive pre-treatment can be eliminated in the present high speed mechanical plating process. It can be replaced by abrasive means such as steel wire brushes rotating in the solution of caustic or other cleaning or degreasing medium so that degreasing and slight roughening of the surface can be obtained at times as short as 30 seconds. The degreasing solution can be recirculated through the brushes substantially in the same manner as that described for the plating end of the line. Between the cleaning end of the line and the plating end of the line, plain water could be flowed across the steel plate to remove any residual caustic. Simultaneously, the sheet could travel over raised rollers which would tend to prevent any carry over of alkali into the acid plating equipment which preferably utilizes an acid medium. It will be apparent that use of brushes or the like is not required and that other suitable means of roughening the surface mechanically may be used.

I have discovered that pieces of steel coated with, for example, zinc by the present high energy high speed continuous plating process become quite strongly magnetized. Before discovering this, I ruined several magnets in an American Instrument Magnegage. This system has been used for years with high accuracy for determining thickness of non ferrous coatings. Magnetizing of the steel base due to the plating operation not only may make the magnegage readings unreliable but also ruined the magnets which had to be replaced. It is now customary to demagnetize all iron or steel plates subject to continuous plating or high speed plating before the thickness can be determined by magnetic means. While I do not wish to be limited in any way to any theory, it is very possible that, where ferrous metal substrates are employed, the magnetism induced in the substrate (e.g. steel) by the conductive metal powder particles moving through the magnetic field would create an induced magnetic field among the powder particles which would constitute an attractive magnetic force between the steel and the plating powder particles causing them to move into close juxtaposition thereby greatly facilitating the speed of plating. It is difficult to measure the importance of this magnetic field because of the rapid flow of the flocculated particles into the plating member for plating. But is is possible and indeed probable that zinc particles in very close contact with the plating elements could be magnetically attracted to the steel plate and cold welded into the coating. In other words, the magnetic force would be generated in this way. This continuous deformation of iron or steel when it is maintained in roughly the same orientation relative to the earth's axis will induce this ferro magnetic material to become magnetized. The amount of magnetism will be, among other things, a function of the amount of carbon in the steel. If the substrate to be high energy plated in the present process becomes magnetic, then the conductive metal powder particles moving through the magnetic field would become polarized due to the generation of current flowing through them. An induced magnetic field should consist about the powder particles. Therefore, there should be a magnetic attractive force between the steel and the plating powders bringing them into close proximity so that pressure from the plating member can effect the welding necessary in mechanical plating.

What is claimed is:

1. A continuous method of mechanically applying a metal coating on a surface of an object comprising the steps of positioning a mechanical plating member adjacent the surface of an object to be plated, said plating member comprising a plurality of plating elements with void spaces separating the plating elements from one another, said void spaces forming reservoirs for particles of metal to be plated on said surface, providing a liquid medium having a pH of 1.6 to 3.5 and comprising an aqueous liquid carrier and solid metal plating particles in the reservoirs formed by said void spaces of said plating member and in contact with said surface to be plated, said metal particles present in said liquid medium being in the form of a plurality of flocculated masses, each floc comprising a lightweight aggregate of loosely held metal particles, said plating member being positioned relative to said object surface such that said plating elements are urged against said object surface, moving said plating member relative to said object surface in said relative position thereby subjecting said metal particles to mechanical energy sufficient to flatten and cold weld said metal particles to the object surface as a continuous adherent metal coating, and, while moving said plating member relatively to said object surface, providing an additional quantity of said liquid medium in said reservoirs and in contact with said surface to be plated to build up a continuous adherent metallic coating on said surface.

2. A method according to claim 1 wherein said plating member comprises metal plating elements.

3. A method according to claim 2 wherein said metal comprises a non-ferrous metal.

4. A method according to claim 3 wherein said non-ferrous metal comprises copper or copper alloy.

5. A method according to claim 1 wherein said plating member comprises flexible plating elements.

6. A method according to claim 1 wherein said plating member comprises a brush having flexible metal bristles.

7. A method according to claim 6 wherein the distal ends of said metal bristles are flattened.

8. A method according to claim 6 wherein the bristles of said brush are flattened down into a matted configuration.

9. A method according to claim 6 wherein each plating element comprises a discrete bundle of metal bristles.

10. An improved method according to claim 1 wherein said void space contains an absorbent material for facilitating retention of said liquid medium adjacent the object surface.

11. An improved method according to claim 10 wherein said absorbent material comprises sponge.

12. An improved method according to claim 1 wherein said plating member is located at a plating zone and wherein said object is elongate and is moved through said plating zone at a velocity of at least 50 feet per minute.

13. An improved method according to claim 12 wherein said plating member comprises a rotary member which is rotated in a plane parallel to said surface being plated.

14. An improved method according to claim 1 wherein said object surface is metallic.

15. An improved method according to claim 1 wherein said object surface comprises steel.

16. An improved method according to claim 15 wherein said metal particles comprise zinc.

17. An improved method according to claim 1 wherein said object surface is stationary.

18. An improved method according to claim 1 wherein said plating elements are urged against and moved relative to the object surface being plated for not more than 60 seconds.

19. An improved method according to claim 1 wherein the metallic coating provided on said object surface is at least about 0.0005 inches thick.

20. A method according to claim 1 wherein said liquid medium comprises water and a flocculating agent.

21. A method according to claim 1 wherein said liquid medium comprises chemical plating promoter.

22. A method according to claim 1 wherein said liquid medium is acidic.

23. A method according to claim 1 wherein said liquid medium is pre-heated to a temperature sufficient to enhance floc formation.

24. A method according to claim 23 wherein said liquid medium is pre-heated to a temperature of at least 150° F.

25. A method according to claim 1 wherein said liquid medium is prepared before use and is stored for a time sufficient to enhance floc formation prior to use.

26. A method according to claim 1 wherein said object surface is abrasively cleaned prior to effecting plating thereof.

27. A method according to claim 26 wherein the object surface is abrasively cleaned while in contact with a liquid cleaning medium.

28. A method according to claim 1 wherein the object is ferro magnetic and becomes magnetised during the plating step.

* * * * *